United States Patent [19]

White

[11] 4,253,808

[45] Mar. 3, 1981

[54] HYDRAULIC PUMPS

[75] Inventor: Ira G. White, Canal Fulton, Ohio

[73] Assignee: Hunt Valve Co., Inc., Salem, Ohio

[21] Appl. No.: 45,614

[22] Filed: Jun. 5, 1979

[51] Int. Cl.[3] ..... F04C 2/08

[52] U.S. Cl. ..... 418/126

[58] Field of Search ..... 418/126, 128, 132

[56] References Cited

U.S. PATENT DOCUMENTS

| | | | |
|---|---|---|---|
| 367,374 | 8/1887 | Deming | 418/126 |
| 2,622,534 | 12/1952 | Johnson | 418/126 |
| 2,742,254 | 4/1956 | Banker | 418/132 |
| 2,809,592 | 10/1957 | Miller | 418/132 |
| 2,817,297 | 12/1957 | Mosbacher | 418/126 |
| 2,932,254 | 4/1960 | Booth | 418/132 |
| 3,174,435 | 3/1965 | Sisson et al. | 418/132 |
| 4,065,235 | 12/1977 | Furlong | 418/126 |
| 4,090,820 | 5/1978 | Teruyama | 418/132 |

FOREIGN PATENT DOCUMENTS 2419855 11/1974 Fed. Rep. of Germany ..... 418/132

OTHER PUBLICATIONS

Tyrone Hydraulics Inc. Publication.
Commercial Shearing Inc. Publication 1976.

*Primary Examiner*—Herbert Goldstein
*Attorney, Agent, or Firm*—Michael Williams

[57] ABSTRACT

A gear pump for use particularly with the new type water hydraulic fluids. A gear track insert is located in the gear housing pressure-generating zone to protect the gear housing from abrasion and high pressure wear. The gear track insert is replaceable, when required, thereby saving the more expensive cost of replacing the gear housing. Isolation seals are of a new design to eliminate high pressure from leaking into the low pressure zone of the pump. These seals also control the pressure plate to gear face load to minimize wear and leakage.

8 Claims, 7 Drawing Figures

HYDRAULIC PUMPS

BACKGROUND AND SUMMARY

During the early 19th century, when industrialization was just getting under way, water was the accepted liquid to power hydraulic systems. But with the development of more sophisticated hydraulic systems, water was pushed into the background as the need for viscosity and lubricity to prevent pump wear increased, and water was therefore replaced by petroleum hydraulic fluids.

However, the recent oil shortages and the tremendous increase in oil prices have brought about a renewed industrial interest in a water-based hydraulic fluid and brought about development of soluble oils consisting of a mixture of about 95% water and 5% oil dispersed in the water.

More recent restrictions brought about by the great interest in environmental control have further increased the interest in high water-based hydraulic fluids because many of such fluids are either biodegradable or easily disposed of; are fire resistant; and are compatible with other water-based products used as coolants.

However, because water, and even high water-based hydraulic fluids have the disadvantages of causing corrosion, and are low in viscosity and lubricity, the pumps designed to use these low-cost hydraulic fluids were extremely expensive and, even so, had materially shorter life spans than the pumps designed for use of oil only as the hydraulic fluid.

The present invention overcomes the disadvantages in pumps of prior design by providing a relatively low-cost gear pump that will work equally as well with oil or high water-based hydraulic fluids and, in the latter case have a usefull life as great as, if not greater than, gear pumps designed for use with oil only.

A feature of my improved pump is the use of a gear track insert located in the gear housing pressure-generating zone. This insert is made of a high-wear and abrasive-resistant material for long pump life, and may be easily replaced during a pump overhaul. Since the gear track insert absorbs most of the wear and abrasion in the pressure-generating zone, the more expensive gear housing is largely relieved of wear and therefore very rarely has to be replaced.

A further feature of my improved pump is the use of isolation seals to reduce or eliminate high pressure from leaking into the low pressure zone of the pump. These seals also control the pressure plate to gear face load to minimize wear and leakage. These, and other features, make my improved pump unique when compared to pumps of prior design.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

Figure 1:
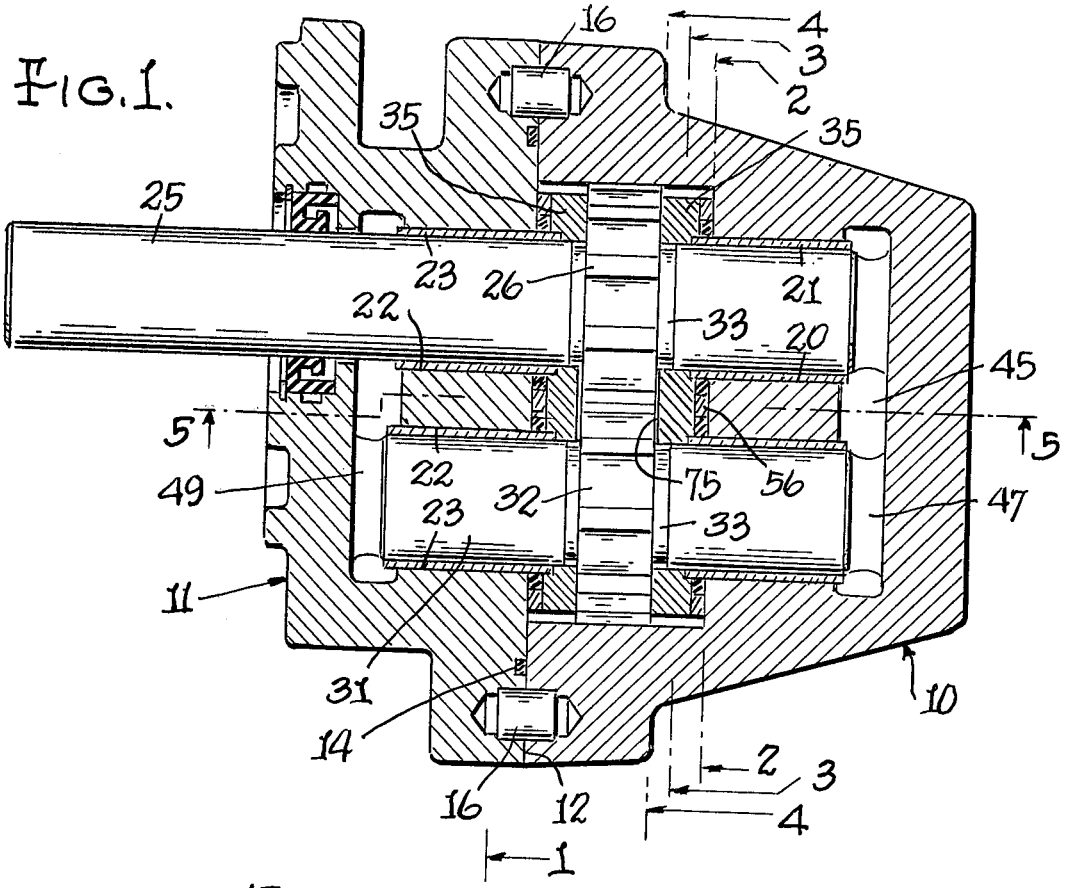
FIG. 1 is a sectional view through a gear pump showing a presently-preferred embodiment of my invention, and corresponding to the line 1—1 of FIG. 2.

As best seen in FIG. 1, the pump comprises a housing 10 and a flange 11, the two constituting the enclosure for pump parts to be described hereinafter. The housing and flange are castings preferably of aluminum or aluminum alloys, to resist corrosion. The castings are suitably cored to provide openings and recesses for the accomodation of the internal pump parts. The castings have respective flat surfaces meeting at the plane 12 and an O-ring 14 is disposed between these flat surfaces to prevent fluid leakage.

Figure 2:
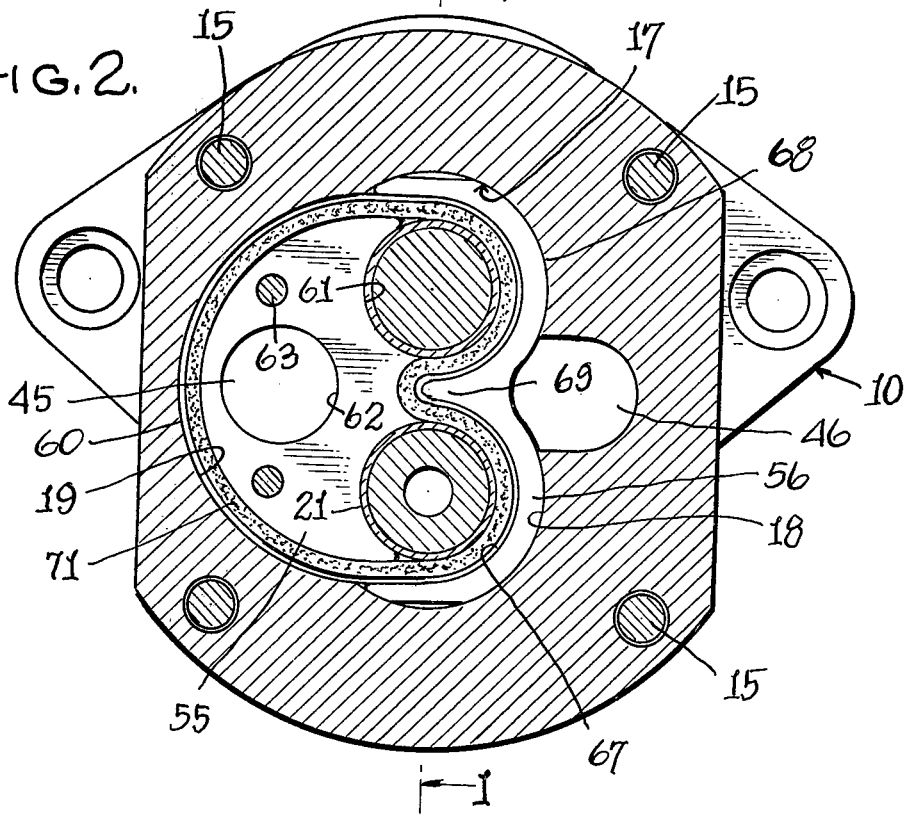
FIG. 2 is a sectional view corresponding to the line 2—2 of FIG. 1.
Figure 3:
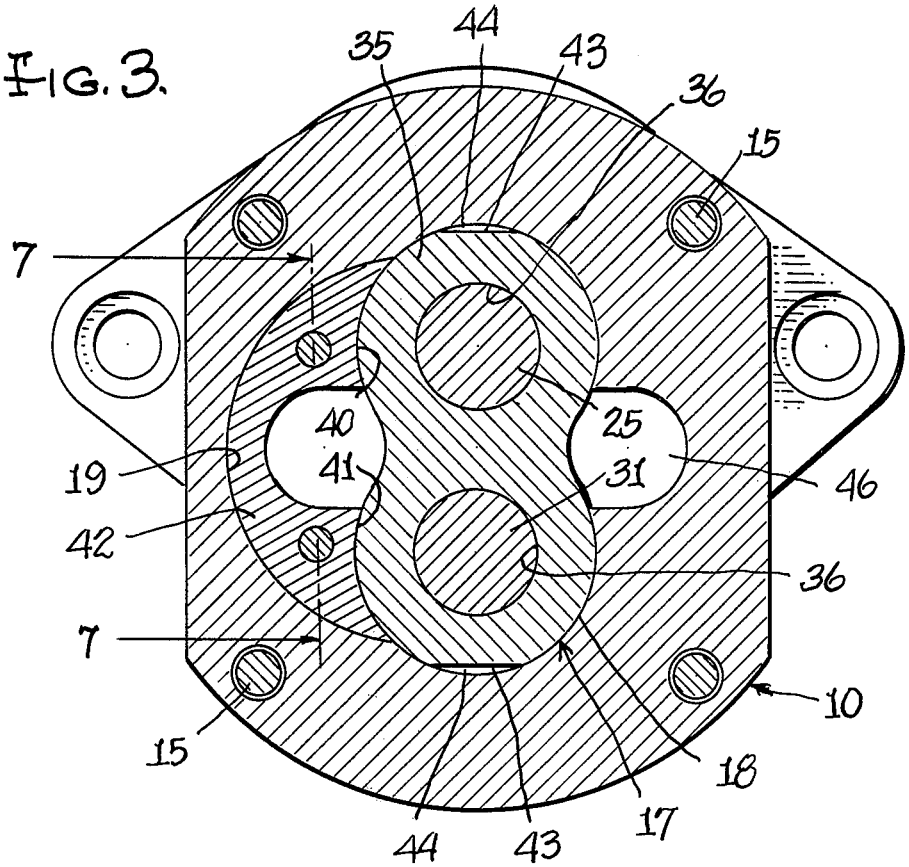
FIG. 3 is a sectional view corresponding to the line 3—3 of FIG. 1.
Figure 4:
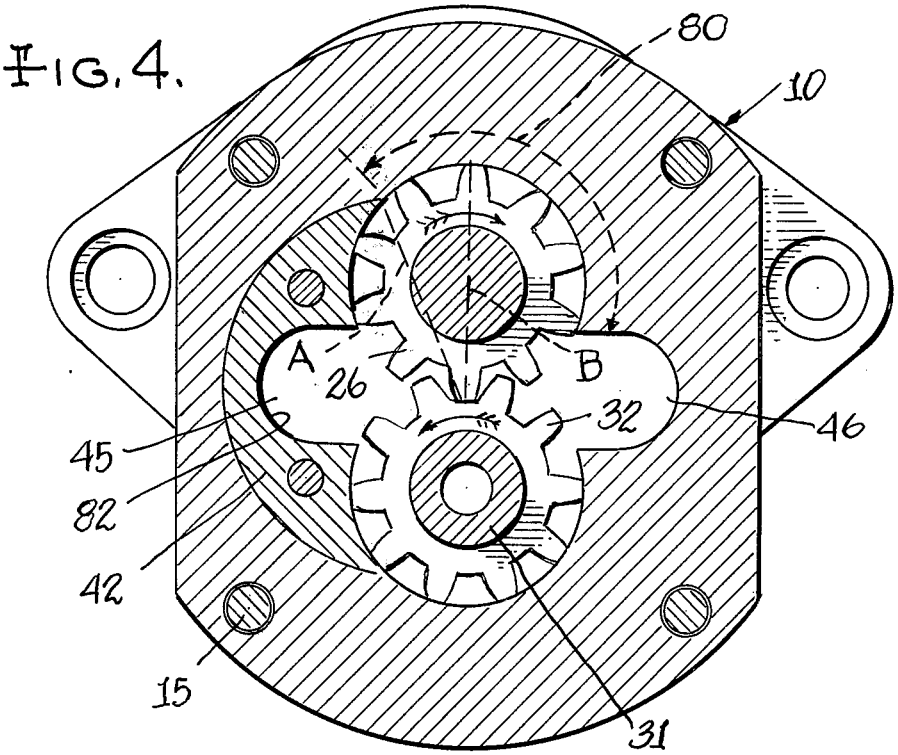
FIG. 4 is a sectional view corresponding to the line 4—4 of FIG. 1.

The flat surfaces are held in tight abutment by draw bolts 15, four being presently used, as shown in FIGS. 2 through 4. Dowell pins 16 are seated in corresponding recesses in the flat surfaces to accurately orient the housing 10 with the flange 11. Extending inwardly from the face of the housing 10 is an opening 17 that may be described as having the shape of the number three, at 18, which merges with a semicircular shape shown at 19. The housing has a pair of circular openings 20—20 in which sleeve bearings 21—21 are held by a press fit. The flange 11 is also formed with a pair of circular openings 22—22 in which sleeve bearings 23—23 are held by a press fit. The dowells 16 insure that the sleeve bearings 21,23 are precisely axially aligned.

Journalled within one set of axially-aligned sleeve bearings 21,23 are ends of a drive shaft 25, the shaft carrying the drive gear 26. It is presently preferred to form the gear 26 integral with the shaft and of a high-wear, abrasion-resistant material, such as Nitralloy 135 modified, heat treated, stress relieved and nitrided. The shaft has a keyway 30 for receiving a key (not shown) to rotatively connect the shaft to a motor (not shown) through a self-aligning flexible coupling.

Journalled within the other set of axially-aligned sleeve bearings 21,23 are ends of a hollow idler shaft 31, the shaft carrying the idler gear 32. The shaft and gear are preferably made integral and of the same material as the shaft 25 and gear 26.

As seen in FIG. 1, the meshing gears 26 and 32 are within the opening 17 midway of the opposite ends thereof. The gears 26 and 32 are preferably four or five pitch spur or herringbone gears, with a pressure angle of about 25 degrees. Each shaft has annular undercuts 33 on opposite sides of its supported gear, as best seen in FIG. 1.

Figure 6:
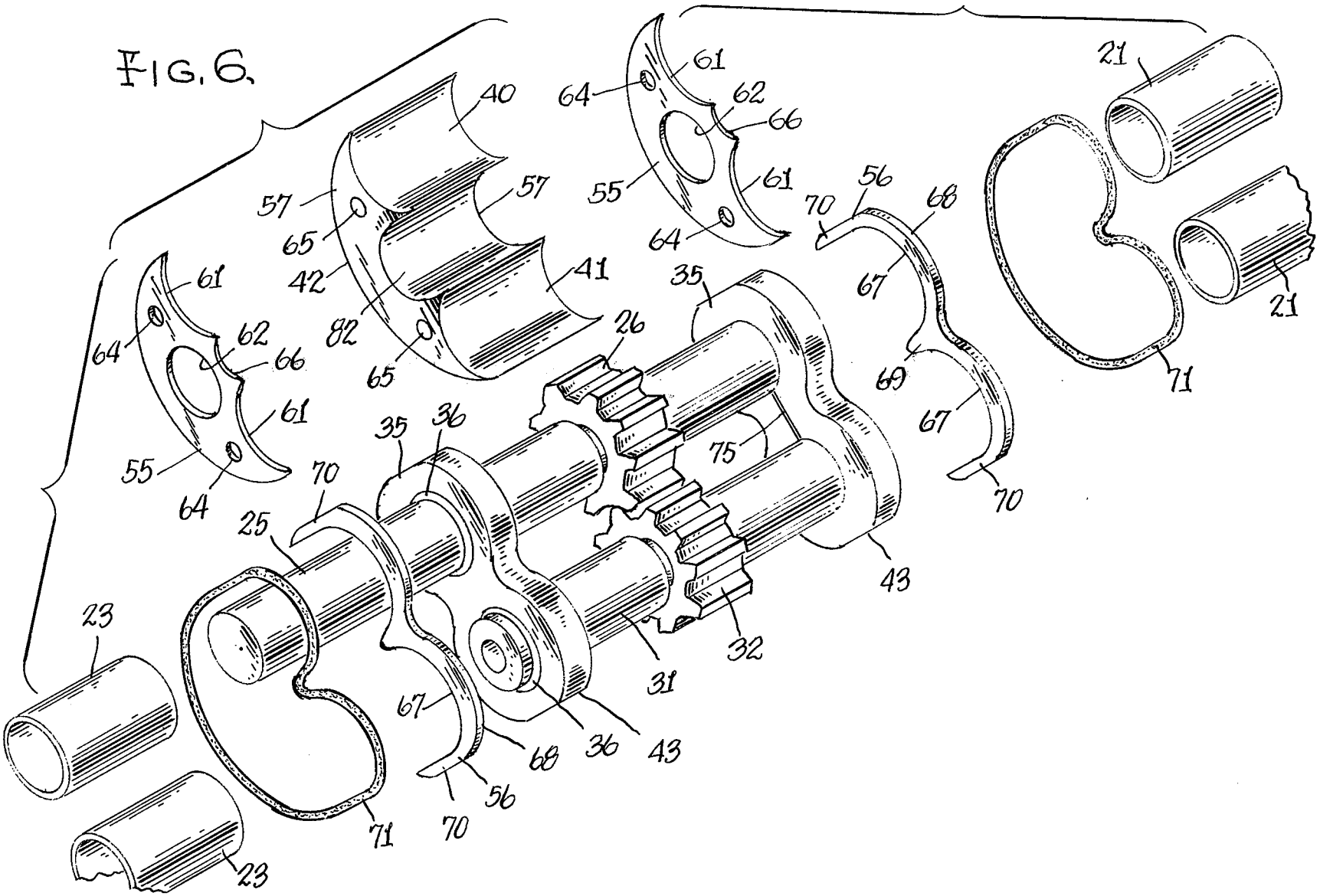
FIG. 6 is an exploded perspective view of interior parts of my improved pump.

Pressure plates 35 are placed at each side of the meshing gears. Each pressure plate is in the shape of a figure eight with opposite flat sides, as best seen in FIGS. 3 and 6, and has a pair of openings 36,36 to pass respective shafts 25 and 31. Each opening has a surrounding annular groove on its outwardly-directed flat side to closely receive the adjoining end of a sleeve bearing. The inwardly-directed flat sides of the pressure plates engage the respective sides of the meshing gears.

As seen in FIG. 3, the pressure plates fit closely within the figure three portion 18 of the housing opening 17 and also fit closely with mating arcuate surfaces 40,41 of a gear track insert 42, the latter having an outer edge peripheral surface closely fitting with the semicircular portion 19 of the housing opening 17. Each pressure plate has oppositely-disposed flat edge surfaces 43,43, as best seen in FIG. 3, each surface forming a slight space 44 with the adjoining portion of the opening 18.

Figure 5:
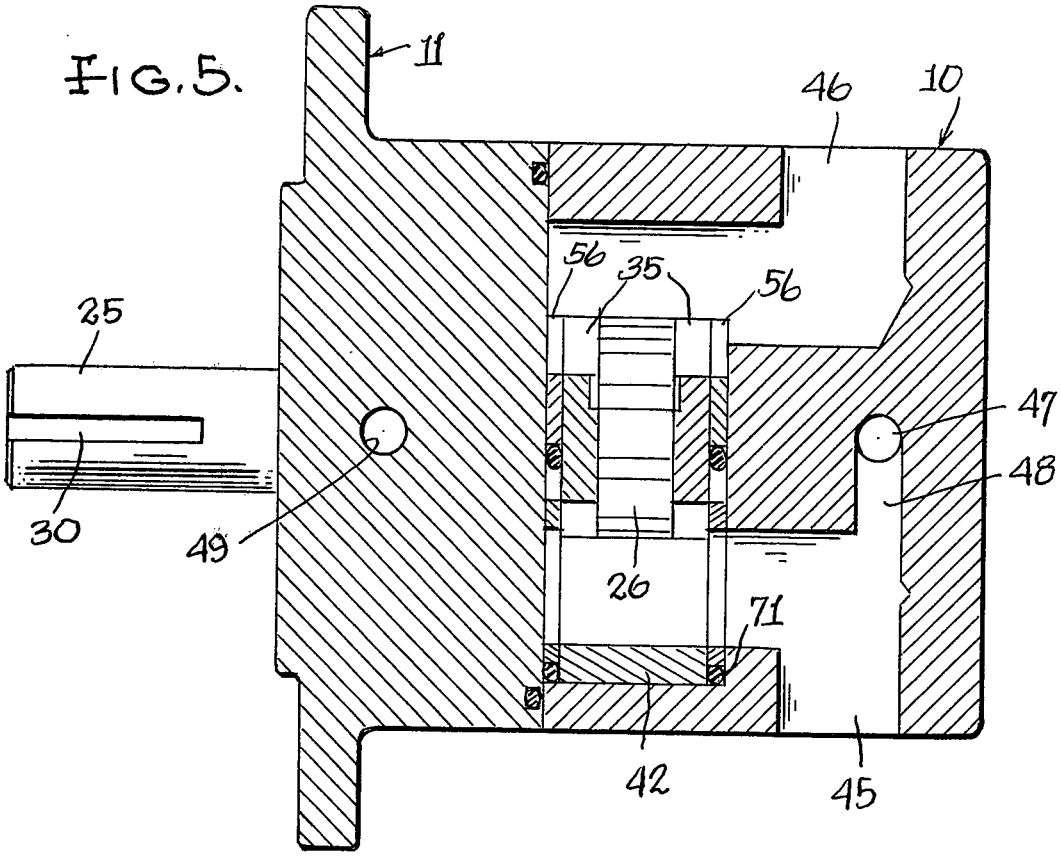
FIG. 5 is a sectional view corresponding to the line 5—5 of FIG. 1.

As seen in the several views, and particularly in FIG. 5, the housing 10 has an inlet or suction opening 45 which is adapted to be connected to a tank containing the hydraulic fluid to be pumped. The housing 10 also has a pressure or outlet opening 46 adapted to be connected to any device for receiving the pressurized hydraulic fluid. The housing 10 is cored to provide a space 47 behind the right-hand ends of the shafts 23,31 (see FIG. 1) and a small opening 48 establishes communication between this space and the inlet opening 45. The flange 11 is cored to provide a space 49 in front of the left-hand end of the shaft 31 (see FIG. 1) and the hollow shaft 31 establishes communication between this space and the inlet opening 45.

A pair of complementary flat spacer plates 55 and 56 (see FIGS. 2 and 6) bear against the outwardly-directed surfaces of respective pressure plates 35,35, and against opposite flat side surfaces 57 of the gear track insert 42 to fill the space provided by the opening 17 in the pump housing 10, as seen in FIG. 1.

Figure 7:
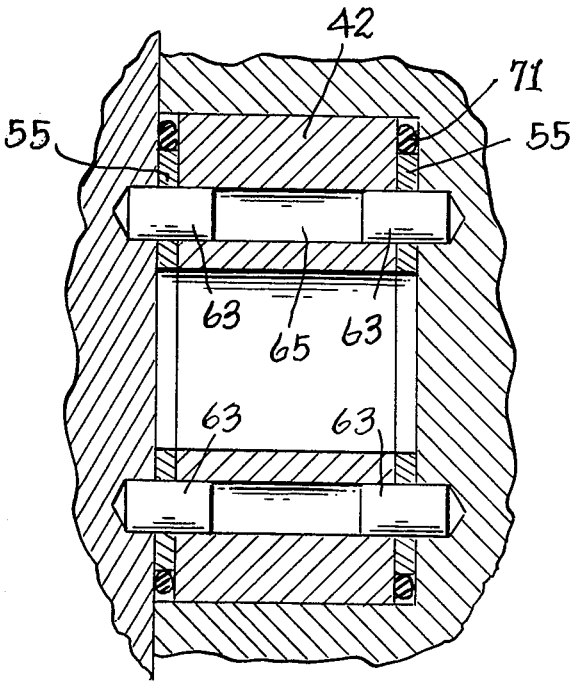
FIG. 7 is a fragmentary sectional view corresponding to the line 7—7 of FIG. 3.

Each spacer plate 55 is of quarter-moon shape and has a semicircular edge corresponding to the portion 19 of the housing opening 17, but is of less radius to form a space 60 therebetween. Each spacer plate also has a pair of arcuate edges 61,61 to closely fit around adjoining portions of the sleeve bearings 21,23 and an opening 62 to communicate with the housing inlet opening 45. The gear track insert 42 and spacer plates 55 are held in position by dowell pins 63 (see FIG. 7) which are seated in openings in the pump housing 10 and flange 11, and extend through openings 64,64 in the spacer plates 55 and within openings 65,65 in the gear track insert 42. Each spacer plate has a small central arcuate recess 66 for a purpose to be described.

The spacer plates 56 are of a figure three shape and have an inner edge surface 67, which fits around, but is spaced from, the sleeve bearings 21,23 and an outer edge surface 68 which closely fits within portion 18 of the housing opening 17. The inner edge surface 67 has a central portion 69 which is complementary to, but is spaced from, the central recess 66 of a respective spacer plate 55. Each spacer plate 56 has opposite flats 70,70 corresponding to the flats 43 on the pressure plates 35 to provide a continuation of the spaces 44.

Each set of spacer plates 55 and 56 combine to contain an O-ring seal 71 wich is of the shape best shown in FIGS. 2 and 6 and preferably made of Viton, having a 90 durometer. Each seal prevents flow of the hydraulic fluid over the outer surface of a respective sleeve bearing. As seen in FIGS. 1 and 6, each pressure plate has a narrow slot 75 on its inwardly-directed surface and extending between its openings 36,36, for a purpose to be described.

The gear track insert 42 is made of a metal having excellent wear and abrasive resistance and presently it is preferred to form this insert of aluminum bronze or stainless steel. The gear track 42 has a thickness equal to the combined thickness of the gears and the pressure plates 35 on opposite sides thereof.

As seen in FIG. 4, the arcuate surfaces 40,41 of the gear track insert 42 have the same radius as the outside diameter of respective gears 26 and 32 and closely interfit therewith. Sleeve bearing to shaft clearance is such that the gears come in contact with respective gear track insert surfaces 40,41 and machine their own track at startup, thereby creating zero clearance during operation under pressure. These arcuate surfaces also closely interfit with adjoining surfaces of the pressure plates, as seen in FIG. 4. The surfaces of the housing opening 17, denoted by the dotted lines 80 in FIG. 4, need not have the close fit with the gears 26 and 32 as the insert surfaces 40,41 do, since all pressure is generated between the gears and the insert surfaces 40. Therefore there is very little wear at the pump housng surfaces and the costly pump housing very seldom needs replacement or repair.

As shown in FIG. 4 the gear track insert surfaces 40,41 are of an extent less than 90 degrees of gear rotation so that only about two gear teeth are in contact with them at any time. To calculate maximum bearing loads, the length of the line A from the pressure end of an insert, times the width of the gear, times operating pressure, will provide such load, and it will be seen that the bearing load in my improved pump is less than the load in prior art pumps having no gear track insert, since the load in that case would be calculated by the longer line B times the width of the gear, and the operating pressure. Thus not only is the pump housing 10 protected from wear, but so are the sleeve bearings because of the lesser amount of load thereon.

In operation, with a suitable motor rotating the shaft 25, hydraulic fluid is drawn into the inlet port 45 of the pump housing 10, and passes through aligned openings 62 and 82, respectively in the spacer plate 55 and gear track insert 42. The opening 82 in the insert is in the form of an arcuate slot so that the hydraulic fluid may pass directly to the space adjoining the meshing gears 26 and 32. The gears are rotated in the direction of the arrows shown in FIG. 4 and therefore the gear teeth pick up the hydraulic fluid and move it to the respective arcuate surfaces 40,41 of the gear track insert where it is trapped between the gear teeth, pressure plates and the insert surfaces to build up fluid pressure. When the gear teeth and trapped fluid reach the outermost end of the insert surfaces 40,41 maximum pressure has been reached and the fluid moves out the outlet opening 46 of the pump housing, from which it is piped to a device for controlling or using such fluid.

Since the pressure plates 35,35 do not form an absolute seal with the sides of the gears, some of the pumped fluid will enter the narrow slots 75 formed on the inwardly-directed flat surfaces of the pressure plates and will flow into the annular undercuts 33 on the shafts 25 and 31, from whence it will pass between the interior of the sleeve bearings 21 and 23 to the spaces 47 and 49, and will then return to the inlet opening. This fluid will lubricate the bearings and maintain them at a lower operating temperature. Such hydraulic fluid will also pass between the side surfaces of the gears and the inwardly-directed surfaces of the pressure plates and to the spaces 44,44 to balance fluid pressure on each side of a pressure plate.

If for any reason it is required to inspect the interior parts of the pump, it is only necessary to remove the bolts 15 and the pump flange 11, and shafts 25,31, pressure and spacer plates and gears 26,32 may be withdrawn from the pump housing opening 17. The gear track inserts 42 are also readily accessible and, in some instances may be withdrawn with the pump flange 11.

All parts are therefore visible for inspection for wear and may be replaced with a minimum of labor.

I claim:

1. A gear pump for pumping hydraulic fluid, particularly water hydraulic fluids, comprising:

a pump housing having a chamber and a pair of meshing gears within said chamber, said housing having inlet and outlet ports communicating with said chamber at respective low- and high-pressure sides of the intermesh of said gears, said chamber having opposed circular portions corresponding to the outside circle of the teeth of respective gears, and said chamber having a semicircular portion at the low-pressure side of said gears, each of said gears having shaft portions extending from opposite sides thereof and journalled in respective sleeve bearings which are carried by said housing, a pair of flat-pressure plates, each having an inwardly-directed surface bearing against a respective side of said gears and each having openings to pass said shaft portions, two pairs of complementary flat first- and second-spacer plates of equal thickness, each pair having inwardly-directed flat surfaces bearing against respective outwardly-directed surfaces of said pressure plates and each pair having outwardly-directed flat surfaces bearing against respective defining side walls of said housing chamber, each first-spacer plate having a figure-three configuration with a pair of arcuate-edge surfaces fitting respective chamber circular portions and a pair of inner-edge surfaces surrounding but spaced from adjoining peripheral portions of said sleeve bearings, each second-spacer plate being of quarter-moon shape and disposed at the low-pressure side of said gears, each having an outer semicircular edge spaced from the semicircle portion of said housing chamber, a pair of arcuate inner edges fitting about respective sleeve bearings and a small arcuate recess intermediate thereof, and a seal squeezed between the outwardly-directed surfaces of said pressure plates and respective defining side walls of said housing chamber, said seal fitting around the semicircular portion of each second-spacer plate and within the inner edge portions of said first-spacer plate.

2. A gear pump for pumping hydraulic fluid, particularly water hydraulic fluids, comprising:

a pump housing having a chamber and a pair of meshing gears within said chamber, said chamber having a pair of circular portions corresponding to the outside circle of the teeth of respective gears, and said housing having inlet and outlet ports communicating with said chamber at respective low- and high-pressure sides of the intermesh of said gears, insert means within said chamber and of wear and abrasion-resistant material, said insert means being disposed in the low pressure side of said chamber and providing a track surface for each gear along which the teeth of the rotating gears closely ride to entrap hydraulic fluid and increase the pressure thereof, and a pair of pressure plates having inwardly-directed flat surfaces disposed against opposite sides of said meshing gears, each pressure plate having opposed circular-edge surfaces closely fitting within said chamber circular portions and with said track surfaces.

3. A gear pump for pumping hydraulic fluid, particularly water hydraulic fluids, comprising:

a pump housing having a chamber and a pair of meshing gears within said chamber, the latter having spaced flat side surfaces with said meshing gears between but spaced from said flat surfaces, a pair of pressure plates on opposite sides of said gears, each pressure plate having opposite flat surfaces, with an inwardly-directed flat surface of each plate bearing against a respective side of a gear, said chamber having a pair of circular portions corresponding to the outside circle of the teeth of respective gears, and said housing having inlet and outlet ports communicating with said chamber at respective low- and high-pressure sides of the intermesh of said gears, insert means within said chamber and of wear and abrasion-resistant material, said insert means being disposed in the low-pressure side of said chamber and providing a track surface of each gear along which the teeth of the rotating gears closely ride to entrap hydraulic fluid and increase the pressure thereof, said insert means being of a thickness equal to the combined width of said gears and said pressure plates, and flat spacer plates bearing against the outwardly-directed surfaces of respective pressure plates and against respective flat surfaces of said housing chamber, each of said spacer plates providing a guide for a sealing member.

4. The construction according to claim 2 wherein said insert means and said pressure plates are formed of metal, a circular-edge surface of each pressure plate accurately and closely fitting with said track surface to form a metal-to-metal seal.

5. The construction according to claim 4 wherein said pressure plates are pressure-loaded in a direction toward said track surface to maintain said metal-to-metal seal.

6. The construction according to claim 2 wherein said insert means and said pump housing have interengagable parts to positively hold said insert means in position.

7. The construction according to claim 6 wherein said interengagable parts comprise a dowel pin carried by said pump housing closely fitting within an opening in said insert means.

8. The construction according to claim 2 wherein each of said pressure plates has an outwardly-directed flat surface closely spaced from a correspondingly flat surface of said chamber, and a seal interposed between each of said outwardly-directed flat surfaces and a respective flat surface of said chamber to seal said high-pressure side from said low-pressure side.

* * * * *